US011056084B1

(12) United States Patent
Gunderson

(10) Patent No.: US 11,056,084 B1
(45) Date of Patent: Jul. 6, 2021

(54) PIN TURNING TOOL KIT

(71) Applicant: John H Gunderson, Neptune City, NJ (US)

(72) Inventor: John H Gunderson, Neptune City, NJ (US)

( * ) Notice: Subject to any disclaimer, the term of this patent is extended or adjusted under 35 U.S.C. 154(b) by 0 days.

(21) Appl. No.: 17/228,574

(22) Filed: Apr. 12, 2021

Related U.S. Application Data

(60) Provisional application No. 63/012,012, filed on Apr. 17, 2020.

(51) Int. Cl.
*G10C 3/106* (2019.01)
*G10C 9/00* (2019.01)

(52) U.S. Cl.
CPC ..... *G10C 3/106* (2013.01); *G10C 9/00* (2013.01)

(58) Field of Classification Search
CPC ..... G10C 3/106; G10C 9/00
See application file for complete search history.

(56) References Cited

U.S. PATENT DOCUMENTS 1,007 A * 11/1838 Smith ..... G10C 9/00 84/459
11,852 A * 10/1854 Bassford ..... G10C 9/00 84/459
83,734 A * 11/1868 Sherwood ..... G10C 9/00 84/459
106,145 A * 8/1870 Farnsworth ..... G10C 3/106 84/202
140,450 A * 7/1873 Affleck ..... G10C 9/00 84/459
215,486 A * 5/1879 Siedersleben ..... G10C 9/00 84/200
245,382 A * 8/1881 Jones ..... G10C 9/00 84/459
310,673 A * 1/1885 Hale ..... G10C 9/00 84/459
318,981 A * 6/1885 Green ..... G10C 9/00 84/459
342,051 A * 5/1886 Steets ..... G10C 9/00 84/459
360,871 A * 4/1887 Finney ..... G10C 9/00 84/459
458,568 A * 9/1891 Fuchs ..... G10C 9/00 84/459
528,154 A * 10/1894 Fuchs ..... G10C 9/00 84/459
610,973 A * 9/1898 Powell ..... G10C 9/00 84/459

(Continued)

*Primary Examiner* — Robert W Horn

(57) ABSTRACT

An improved piano tuning lever includes a handle with a loop or ring large enough to fit the fingers of a user's hand, thereby providing a grip around the perimeter of the loop or ring which is independent of the axis of the handle. The resulting grip affords improved ergonomics and may lessen stress in the user's wrist and hand when having to conform to various angles of the handle axis as the tuning lever is moved from tuning pin to tuning pin over the course of a piano tuning. The improved handle and loop or ring may be made any size or shape, symmetrical or asymmetrical and with its core being solid, hollow, or filled. Another embodiment of the piano tuning lever includes a spline designed to mate with an inventive piano tuning lever head having complementary splines.

20 Claims, 7 Drawing Sheets

(56) References Cited

U.S. PATENT DOCUMENTS 634,016 A * 10/1899 Mueller ..... G10C 9/00 84/459
641,473 A * 1/1900 Sihler ..... G10C 9/00 84/459
680,926 A * 8/1901 Klinder ..... G10C 9/00 84/459
729,804 A * 6/1903 Stoddard ..... G10C 9/00 84/459
768,447 A * 8/1904 Goodenow ..... G10C 9/00 84/459
775,383 A * 11/1904 Porter ..... G10C 9/00 84/459
794,772 A * 7/1905 Bediant ..... G10C 9/00 84/459
820,418 A * 5/1906 Hindman ..... G10C 9/00 84/459
834,468 A * 10/1906 Hake ..... G10C 9/00 84/459
842,307 A * 1/1907 Ellsworth ..... G10C 9/00 84/459
892,506 A * 7/1908 Dolan ..... G10C 9/00 84/459
997,143 A * 7/1911 Lind ..... G10C 9/00 84/459
1,123,932 A * 1/1915 Ryan ..... G10C 9/00 84/459
1,160,107 A * 11/1915 Hale ..... G10C 9/00 84/459
1,512,699 A * 10/1924 Korach ..... G10C 9/00 84/459
1,693,292 A * 11/1928 Frauenberger ..... G10C 9/00 84/459
2,065,342 A * 12/1936 Mockly ..... G10C 3/106 84/202
2,172,355 A * 9/1939 Brady ..... G10C 3/10 84/459
2,608,119 A * 8/1952 MacCheyne ..... B25B 23/00 81/60
2,802,388 A * 8/1957 Luckenbach ..... G10C 3/10 84/459
3,004,455 A * 10/1961 Bashore ..... B25B 13/481 81/61
4,476,770 A * 10/1984 McGowan ..... G10C 9/00 84/204
5,065,660 A * 11/1991 de Buda ..... G10G 7/02 84/200
7,638,702 B2 * 12/2009 Fujan ..... G10C 9/00 81/22
7,718,880 B1 * 5/2010 Levitan ..... G10C 9/00 84/453
2013/0112064 A1 * 5/2013 Ginter ..... G10D 13/00 84/458
2020/0406436 A1 * 12/2020 Rosales ..... B25B 13/463

* cited by examiner

PIN TURNING TOOL KIT

CROSS REFERENCE TO RELATED APPLICATION

This US non-provisional utility application claims the benefit of priority to U.S. provisional application 63/012,012 "Pin Turning Tool Kit," filed 17 Apr. 2020. The entire contents of U.S. provisional application 63/012,012 "Pin Turning Tool Kit," filed 17 Apr. 2020 are hereby incorporated into this document by reference.

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

FIELD

The invention relates to hand-held and hand-operated tools for gripping upon and turning pins while tuning pianos and other musical instruments or devices having tension-adjustable strings wherein at least one string end is wound around a rotatably adjustable pin.

BACKGROUND

Pianos are tuned using tools such as a lever with a handle at one end and a socket at another end, the socket having been made to engage the head of a tuning pin. The average piano has over 230 tuning pins. Most commonly, these pins have square cross sections at their protruding ends, and in a piano ready for tuning the points of these square ends are oriented randomly from one pin to the next.

The tuning lever must align itself anew when working each pin and consequently the angle of a tuning lever's handle changes as the lever is moved from pin to pin. The result is that a piano tuner must contort his or her hand, wrist, arm, and shoulder to accommodate each new angle the tuning lever assumes as the entire piano is being tuned.

Considering that the average piano has some 230 tuning pins and the average full-time piano tuner may tune as many as three or four (or more) pianos a day, applying an average of 100 inch pounds of torque to each pin, it is understandable that the repetitive nature of this work can be stressful to a piano tuner's hand, wrist, arm, and shoulder, especially if working with a tool that lacks ergonomic design.

BRIEF DESCRIPTION

The invention is a lever for the purpose of tuning musical instruments in general and pianos especially. The handle end of the lever incorporates an ergonomically designed loop, with the plane of the loop being rotatably adjustable 360° around the centerline of the axis of a stem protruding from the handle.

A primary objective of the invention is to provide a tool for tuning stringed musical instruments with an ergonomically designed handle for grasping by hand so that torque may be delivered to a tuning pin without having to contort one's hand, wrist, arm, or shoulder into awkward and uncomfortable positions which result when using a tuning lever with just a simple lever design.

Another objective of the invention is to provide a tool handle with a loop for grasping anywhere around its perimeter, with the plane of the loop being rotatably adjustable around the centerline of the axis of the stem relative to the plane of the head component and tip assembly as it extends from the centerline of the stem axis of the handle. The result of this objective is to give the user the ability to control the orientation of the handle loop to maximize its ease of use while minimizing stress and strain. Thus, by using the invention, the wrist gripping the handle remains within a comfortable, non-injurious range even while the axis of the stem portion of the handle might be at an angle no one could grip comfortably while attempting to exert substantial twisting forces on a tuning pin, and a user gipping and twisting at such an extreme angle would likely incur pain and discomfort and also risk repetitive stress injury. This ability is especially advantageous when one considers the differences between tuning uprights, or vertically strung pianos, and grands, or horizontally strung pianos.

BRIEF DESCRIPTION OF THE DRAWINGS

A further understanding of the nature and advantages of the particular embodiments may be realized by reference to the remaining portions of the specification and the drawings, in which like reference numerals are used to refer to similar components. When reference is made to a reference numeral without specification to an existing sub-label, it is intended to refer to all such similar components.

DETAILED DESCRIPTION OF CERTAIN EMBODIMENTS

Figure 1A:
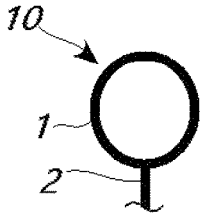
FIGS. 1*a* through 1*q* show a variety of loop shapes for a handle portion of a pin turning tool kit in accordance with the invention.

While various aspects and features of certain embodiments have been summarized above, the following detailed description illustrates a few exemplary embodiments in further detail to enable one skilled in the art to practice such embodiments. The described examples are provided for illustrative purposes and are not intended to limit the scope of the invention.

In the following description, for the purposes of explanation, numerous specific details are set forth in order to provide a thorough understanding of the described embodiments. It will be apparent to one skilled in the art, however, that other embodiments of the present invention may be practiced without some of these specific details. Several embodiments are described herein and while various features are ascribed to different embodiments it should be appreciated that the features described with respect to one embodiment may be incorporated with other embodiments as well. By the same token, however, no single feature or features of any described embodiment should be considered essential to every embodiment of the invention, as other embodiments of the invention may omit such features.

In this application the use of the singular includes the plural unless specifically stated otherwise, and use of the terms "and" and "or" is equivalent to "and/or," also referred to as "non-exclusive or" unless otherwise indicated. Moreover, the use of the term "including," as well as other forms, such as "includes" and "included," should be considered non-exclusive. Also, terms such as "element" or "component" encompass both elements and components comprising one unit and elements and components that comprise more than one unit, unless specifically stated otherwise.

In this specification, the term "means for . . . " as used herein including the claims, is to be interpreted according to 35 USC 112 paragraph 6.

The use of the words "part", element", and "component" shall be interchangeable unless otherwise stated and the use of the words "tip" and "socket" shall have the same meaning unless otherwise stated and the use of the words "machine screw" and "set screw" shall also be interchangeable. The phrase "substantially perpendicular" is used to describe a condition in which a first entity extends in a direction within 15° of perpendicular with respect to a second entity, and "substantially parallel" similarly describes a condition in which a first entity extends in a direction within 15° of parallel with respect to a second entity.

Also in this specification a "piano tuner" is taken to mean a person who tunes pianos and not a device or tool for tuning pianos. A piano tuner and a "user" and a "tool user" and the like may be a person of any gender or sex. Grammatically gendered pronouns including but not limited to the pronouns "he," "she," "his," and "her" may apply interchangeably to any human person and in this specification masculine grammatical gender pronouns and markings may subsume their feminine equivalents. "They," "their," and "them" in this specification always indicate plural entities.

The word "loop" in this specification shall include the meanings of the word "ring" and any extension of material along a closed profile of any shape, size, or form, symmetrical or asymmetrical. For materials, the handle may include wood, plastic, polyamide, polycarbonate, urethane, acrylonitrile butadiene styrene (ABS,) acetal, polypropylene, polyester, polyvinyl chloride (PVC,) epoxy resin, brass, bronze, epoxy, aluminum, iron, steel, fiber-glass, a composite material such as a material comprising a carbon fiber, or a metal alloy. Brand names or common names for some of these materials include Delrin® and nylon. Cross-linked polymers, monadic polymers, dyadic polymers such as 4,6, nylon and 6,6 nylon, and triadic polymers may also be used for components of the invention.

The invention is a kit of components which may be assembled into a musical instrument tuning tool acting as a lever for tuning musical instruments in general and pianos in particular. A musical instrument tuning lever in accordance with the invention has an ergonomically designed handle that increases its ease of use by incorporating into the handle at its proximal end a loop portion or ring portion large enough to admit the fingers of the hand inside the loop or ring, thereby allowing a user to grasp the handle anywhere around the perimeter of its loop, thereby providing the user with a grip axis that is independent of the handle's axis.

The plane of the handle's loop portion may be set at any angle relative to the plane of the head and tip assembly as the head and tip assembly extends from the stem axis of the handle. By setting and resetting the angle of the plane of the loop relative to the plane of the head and tip assembly a user is afforded an infinite variety of grip positions.

The inventive tool lever thereby provides a user with a comfortable and ergonomic grip that may help alleviate the straining of tissues, tendons and muscles and joints in the wrist, hand, arm, and shoulder commonly experienced by piano tuners which may result from having to contort one's hand, wrist, arm, and shoulder to follow the angle of a simple tuning lever as it is moved from tuning pin to tuning pin over the course of a piano tuning.

An alternate embodiment the inventive tool incorporates a collet assembly component with a complimentary collet nut that is permanently inserted into the stem of the handle, the collet assembly being designed to receive a complimentary shaft; the cross section of which may comprise a profile selected from the following set of profiles: rectangular, polygonal, round, round with a key way, and an ovular profile.

The alternate embodiment of the tool with a collet assembly receives a complementary shaft through the collet, coaxial with the axis of the handle stem, the shaft being removable from, extendable, and retractable into and out of the handle through the collet assembly; the collet assembly being able to lock the shaft at any point throughout its extension by tightening the nut and thereby clamping a radial array of collet tangs onto the shaft.

The shaft component of the tool, in both embodiments, may include at its distal end a frustum such as but not limited to a Morse taper, designed to receive a head component because the head component includes its complementary bore. A Morse taper is commonly defined as a taper narrowing transversely approximately ⅝ inch per axial foot.

The shaft component and complementary head component in various alternative embodiments are attached together by their complementary male and female tapers, further comprise a machine screw or a set screw component, preferably with a countersunk head, to hold the head component firmly in place on the shaft, the shaft having a threaded bore at its top center, coaxial with the axis of the shaft, so as to receive the threaded end of the set-screw. The head component is bored and preferably counter-sunk, with the bore preferably also coaxial to the center-line of the shaft's axis, to allow the threaded end of the set screw component to pass through the head component and engage the threaded bore of the shaft component. The screw is first inserted into the head via its bore and then the threaded end of the screw is inserted into the threaded bore of the shaft. The set screw is then tightened to the threaded bore of the shaft, thereby drawing the head component tightly onto the frustum of the shaft.

The inventive tool kit with its component parts assembled in accordance with the invention create a tool offering a unique ability of its handle to be rotatably adjustable around its stem axis so that the plane of the handle's loop, relative to the plane of its tuning head and tip assembly, may be readily set and reset. This increases the utility of the handle's ergonomic design by allowing it to be readily adapted to all types of pianos, including uprights, grands, square grands, or any instrument of any size, shape, or string orientation. A user may adjust the handle to the most comfortable working orientation in the closely confined spaces in any of these instruments. Additionally, in another alternate embodiment of the tool which incorporates a collet assembly and a complementary shaft component, the shaft component is removable from the handle stem and may also be extended and retracted in and out of the handle stem and locked into position at any point along its extension, giving the user the enhanced ability to vary the amount of leverage available when using the tool to apply torque to a tuning pin.

Although primarily directed at engaging tuning pins of a piano, the inventive tool kit may also be used for tuning other stringed instruments having taut strings wound around rotatable pins held by friction in anchor holes in the instrument's pin block or wrest plank. Harps, harpsichords, claviers, and spinets may also be tuned using the inventive tool.

Figure 1B:
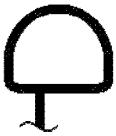
Figure 1C:
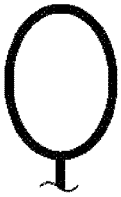
Figure 1D:
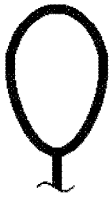
Figure 1E:
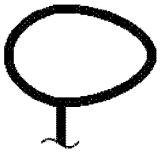
Figure 1F:
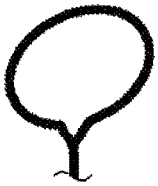
Figure 1G:
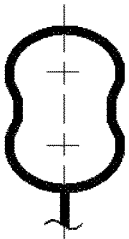
Figure 1H:
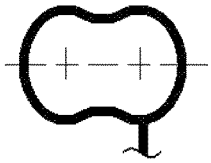
Figure 1I:
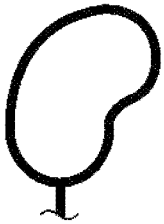
Figure 1J:
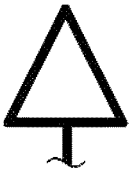
Figure 1K:
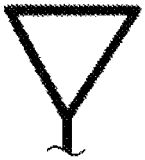
Figure 1L:
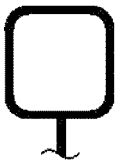
Figure 1M:
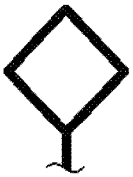
Figure 1N:
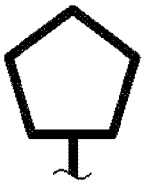
Figure 1O:
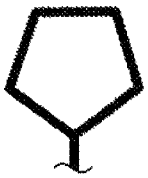
Figure 1P:
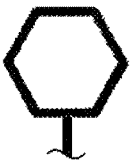
Figure 1Q:
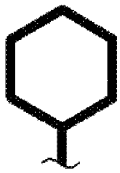

Referring to FIGS. 1*a* through 1*q*, there are many loop shapes for a handle component which reside within the scope of the invention. The tool [10] includes a handle comprising a loop component [1] and a stem component [2]. The loop component comprises a cross section held substantially constant while swept along a profile or contour which is a closed curve or a polygon. According to a best mode the loop cross section is circular and the loop profile is also a circle, resulting in a handle as depicted in FIG. 1*a*. Another loop handle in accordance with the invention comprises first portion having an arc or an arcuate section which may be a circular, a semi-circle, elliptical, or parabolic arc conjoined to a second portion having two substantially parallel straight leg sections connected by a perpendicular leg. FIG. 1*b* shows a handle with a loop portion comprising a semi-circle and a straight section to form a "D" shaped handle.

FIG. 1*c* shows yet another loop which is an ellipse or an oval, and FIG. 1*d* shows another loop which is another ovoid, with the stem extending from the narrow, rounded apex of the ovoid. FIG. 1*e* shows yet another loop section which is an ovoid, but with the stem extending from a location at or near a point in quadrature with the narrow, rounded apex of the ovoid. FIG. 1*f* shows another handle in accordance with the invention which includes a stem joined to a vee portion which bifurcates and is then further conjoined to an elliptical loop portion.

FIG. 1*g* shows bilobate loops similar to a figure-eight, with the stem extending coaxial to an axis defined by a line passing through the centers of the two conjoined elliptical lobes of the loop. FIG. 1*h* shows an alternative embodiment having a bilobate loop, but with the stem extending from one of the lobes in a direction substantially perpendicular to an axis defined by a line passing through the centers of the two conjoined elliptical lobes of the loop.

FIG. 1*i* shows a loop which is a reniform. FIGS. 1*j* and 1*k* show loops which include triangles, with the stem extending substantially perpendicular from a side, and with the stem extending from a corner or apex respectively. FIGS. 1*l* and 1*m* show loops which include squares, with the stem extending substantially perpendicular from a side, and with the stem extending from a corner or apex respectively. A rhomboidal, rectangular, or parallelogram loop also resides within the scope of the invention.

FIGS. 1*n* and 1*o* show loops which include a pentagon, with the stem extending substantially perpendicular from a side, and with the stem extending from a corner or apex respectively, and FIGS. 1*p* and 1*q* show loops which comprise a hexagon, with the stem extending substantially perpendicular from a side, and with the stem extending from a corner or apex respectively. The polygonal loops shown in FIGS. 1*j* through 1*q* may have sharp, distinct corners or they may have filleted or rounded corners. Loops comprising other polygons are also within the scope of the invention. Also, the stem shank section of the handle defines an axis which is preferably coplanar with a contour of the loop of the handle.

Figure 2A:
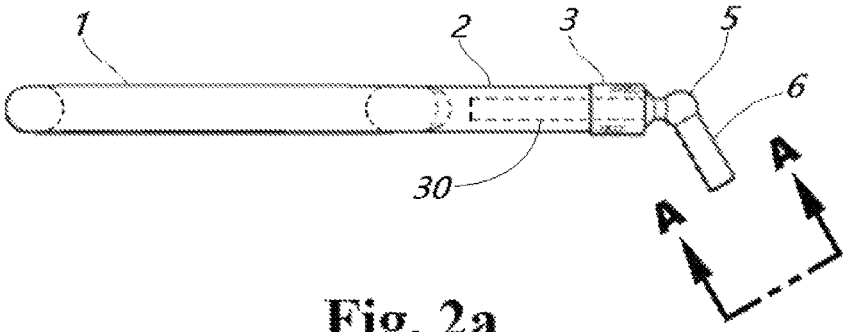
FIG. 2*a* shows a side view of the tuning tool kit in accordance with the invention, including a view line defining an auxiliary view A-A for FIG. 2*c*.
Figure 2B:
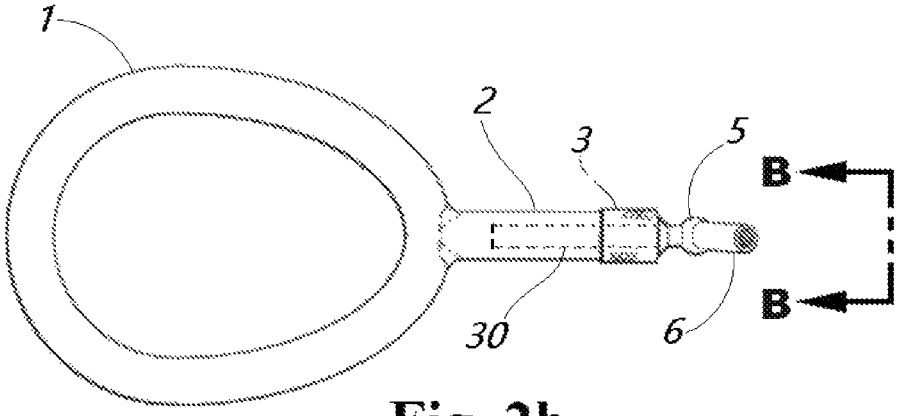
FIG. 2*b* shows a bottom view of the tuning tool kit of FIG. 2*a* including a view line defining an auxiliary view B-B for FIG. 2*e*.
Figure 2C:
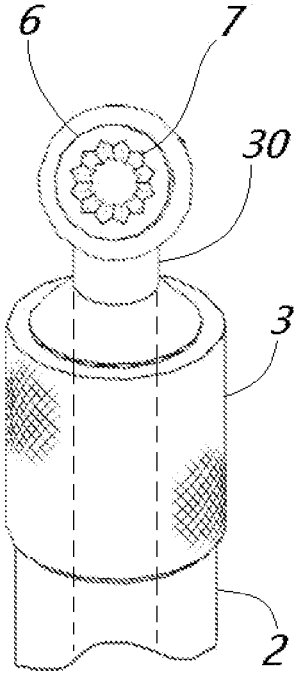
FIG. 2*c* is a view of the distal end of the tuning tool kit of FIG. 2*a* showing a tip component with a tuning pin engagement socket.
Figure 2D:
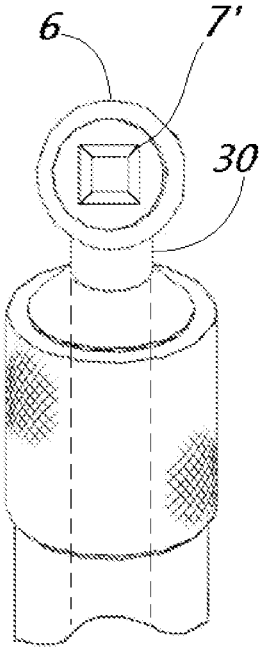
FIG. 2*d* is a view of the distal end of the tuning tool kit of FIG. 2*a* showing a tip component having an alternate tuning pin engagement socket.

FIG. 2*a* shows a side view of a tuning tool assembled from a kit of components in accordance with the invention, including a view line defining an auxiliary view A-A for FIGS. 2*c* and 2*d*. The tool has a handle with a loop portion [1] and a stem portion [2] with an aperture, a ferrule component [3,] a shaft component [30] receivable within the aperture of the handle stem, a head component [5,] and a tip component [6.] In this embodiment the handle stem has a ferrule permanently mounted onto the stem at its distal end, and preferably coaxial with the handle stem axis. The head component is attached to the shaft component by means of complementary tapers on a frustum on the end of the shaft and a conical portion of an aperture in the head component as detailed in FIGS. 5 and 6. Morse standard tapers are a best mode taper. The head and tip assembly is rotatable around the axis of the shaft and its angle with respect to a plane defined by the loop of the handle may be adjusted and fixed by a user of the invention.

FIG. 2*b* shows a bottom view of the tool kit shown in FIG. 2*a*. It includes a view line defining an auxiliary view B-B for FIG. 2*e*. As seen in FIG. 2*a*, the handle has a loop portion [1] and a stem portion [2] extending from the loop to a distal end, a ferrule component [3,] a shaft component [30,] a head component [5,] and a tip component [6] which includes an aperture designed to fit onto and engage a tuning pin of an instrument.

FIG. 2*c* shows the auxiliary view A-A of FIG. 2*a* which shows the distal portion of the tuning tool, including the shaft component [30] received by and emerging through the ferrule component [3,] and a tip component [6] with a first end with means for attachment to the head component, and a second end comprising a socket aperture [7] for engagement with a tuning pin.

FIG. 2*d* shows the auxiliary view A-A of FIG. 2*a* with the shaft component [30] and the tip component [6] having an alternative socket [7'] for engagement with a tuning pin.

Figure 2E:
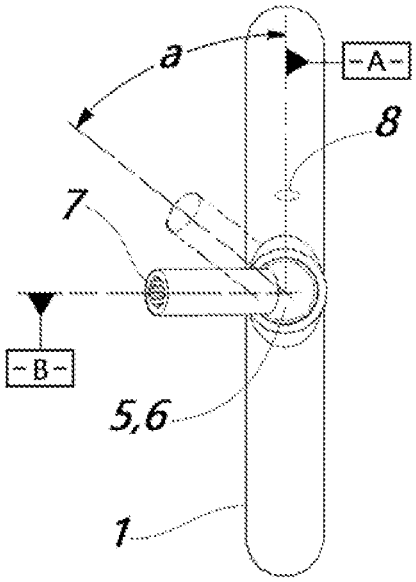
FIG. 2*e* shows the plane of the head and tip assembly of the tuning tool kit being adjustable with respect to the plane of the loop component.

FIG. 2*e* shows the auxiliary view B-B which is a view looking at the distal end of the tool of FIG. 2*b*. It shows the loop portion [1] of the handle and a head component [5] and its tip component [6] assembled as in accordance with the invention. The loop portion of the handle has a centerline contour definable by a succession of cross sections taken around the loop, with a succession of geometric centers of area taken along this plurality of cross sections defining the contour. A midplane [-A-] for the loop handle may be defined by selecting three such center of area points along the handle contour. The head and tip assembly and the angular orientation [a] of the head and tip assembly are adjustable with respect to the plane [8] defined by the loop, with the axis of the shaft component and the axis of the tip component defining an operating plane [-B-] which when in used also contains the rotational axis of the pin being turned. A user may set and lock the assembled tool with planes [-A-] and [-B-] angled to each other in any way comfortable to the gripping wrist of the user, or in orientations that fit well in confined spaces.

Figure 3:
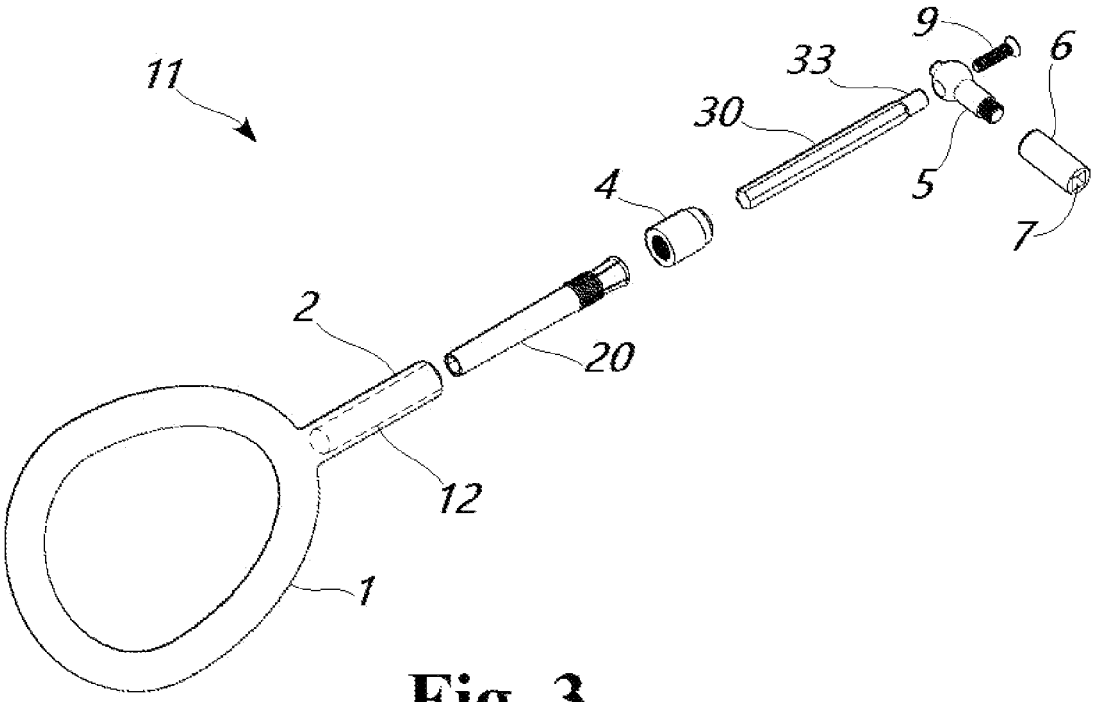
FIG. 3 shows an exploded view of an alternate embodiment of the tuning tool kit with a handle, a collet, a nut, a shaft, a head, and a tip.

FIG. 3 shows an exploded view of an alternate embodiment of the tool kit [11] in accordance with the invention. The kit comprises a handle with a loop [1] and a stem [2] extending from the loop to a distal end, the stem having a aperture [12] extending along a first axis for receiving a collet [20] permanently mounted therein. The collet includes an aperture designed to receive a complementary shaft [30,] the shaft having a cross sectional profile which may be round, ovular, rectangular or of a polygonal cross-section, or of other effective cross sections. The shaft includes a frustum [33] at its distal end with a threaded bore centered on its end surface extending into the shaft coaxial with the axis of shaft for receiving a head and tip assembly [5 and 6.] The shaft in this embodiment may be extended and retracted in and out of the stem as well as being completely removable. Furthermore, the shaft may be locked at any position along its extension by tightening a collet nut [4.] Varying the distance between the handle and the tuning tip by extending and retracting the shaft from the stem provides a user with a means of adjusting the amount of leverage available for applying torque to a tuning pin.

Figure 4:
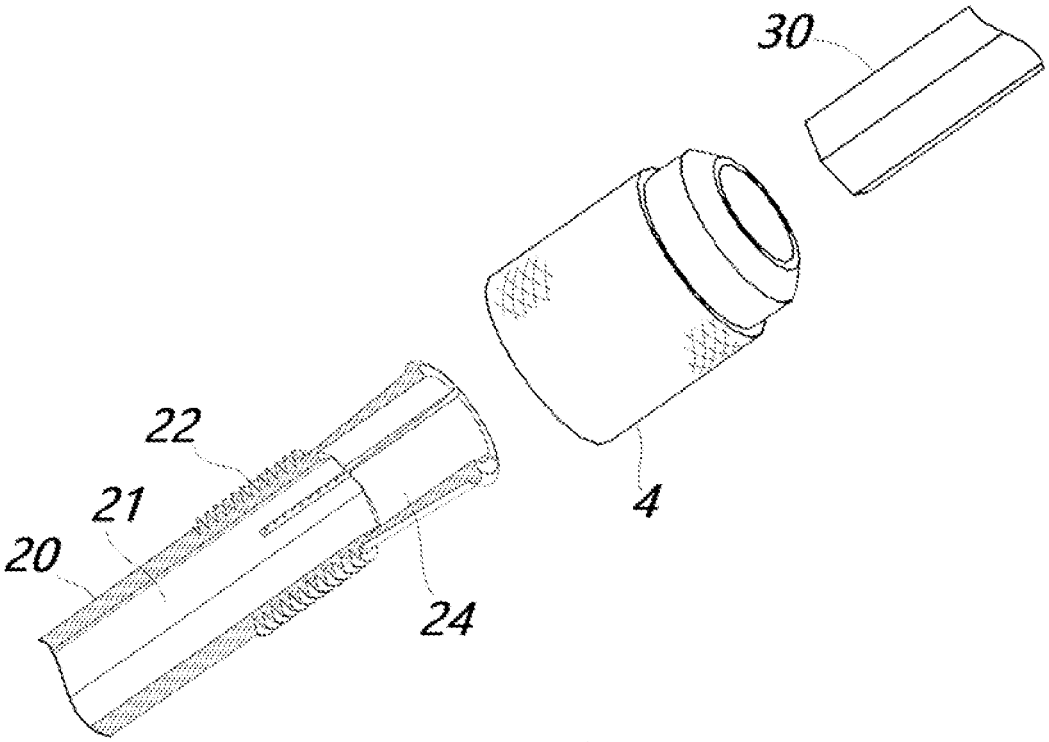
FIG. 4 shows a broken out view of a distal portion of a collet, a nut, and one end of a shaft component.

FIG. 4 shows a broken out view the distal end of a collet, a nut, and a hexagonal shaft in accordance with the invention. The collet has threads [22] for receiving a nut. The collet also has an axial aperture [21] internally with at least a portion of its cross section being complementary to a shaft component. The collet includes a radially array of tangs [24] which are designed to close around a shaft component [30] as the collet nut [4] is tightened onto the collet, thereby locking the shaft at any point throughout its extension in and out of the stem. The ferrule component includes an aperture having a portion with a cross sectional profile complementary to the cross sectional profile of the shaft component. In this figure the shaft has a hexagonal cross section which is complementary to a hexagonal portion of the aperture in the distal portion of the ferrule.

Figure 5A:
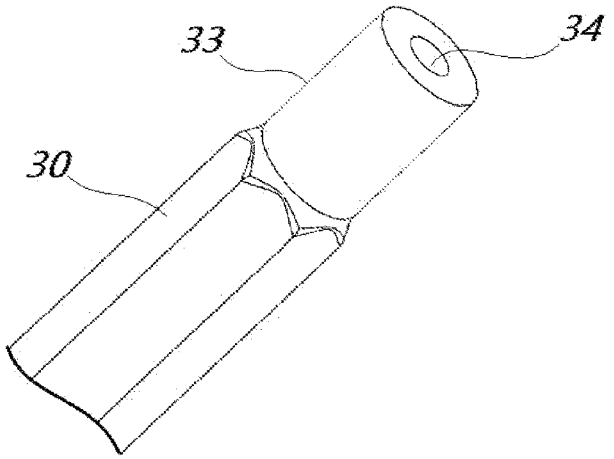
FIG. 5*a* shows a distal end of a shaft component.

FIG. 5*a* shows the distal end of a shaft component [30] in accordance with the invention. It shows a cylindrical surface [33] and a threaded bore [34] for receiving the threaded end of a set screw as means for attachment of the head component. In a best mode, the taper of the frustum is a Morse taper, and preferably but not necessarily, the frustum defines a second, longitudinal axis coaxial with the longitudinal axis of the shaft. Also preferably but not necessarily, the threaded bore in the shaft defines a longitudinal axis coaxial with the axis of the shaft.

Figure 5B:
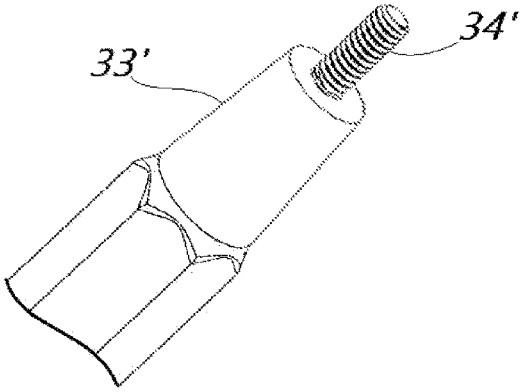
FIG. 5*b* shows a distal end of an alternative embodiment of a shaft component.

FIG. 5*b* shows a distal end of an alternative embodiment of a shaft component. In this embodiment the shaft ends with a portion which is a frustum [33'] and the means for attachment at a first end of the head component comprises male threads, such as a threaded fastener like a set screw. The complementary means [34'] may include female threads in the head component or a threaded fastener having female threads which transfixes the head component and secures it to the shaft component, such as a hex nut or an internally threaded tube having a flange at one end larger than the smallest diameter of through-aperture passing through the head component.

Figure 6:
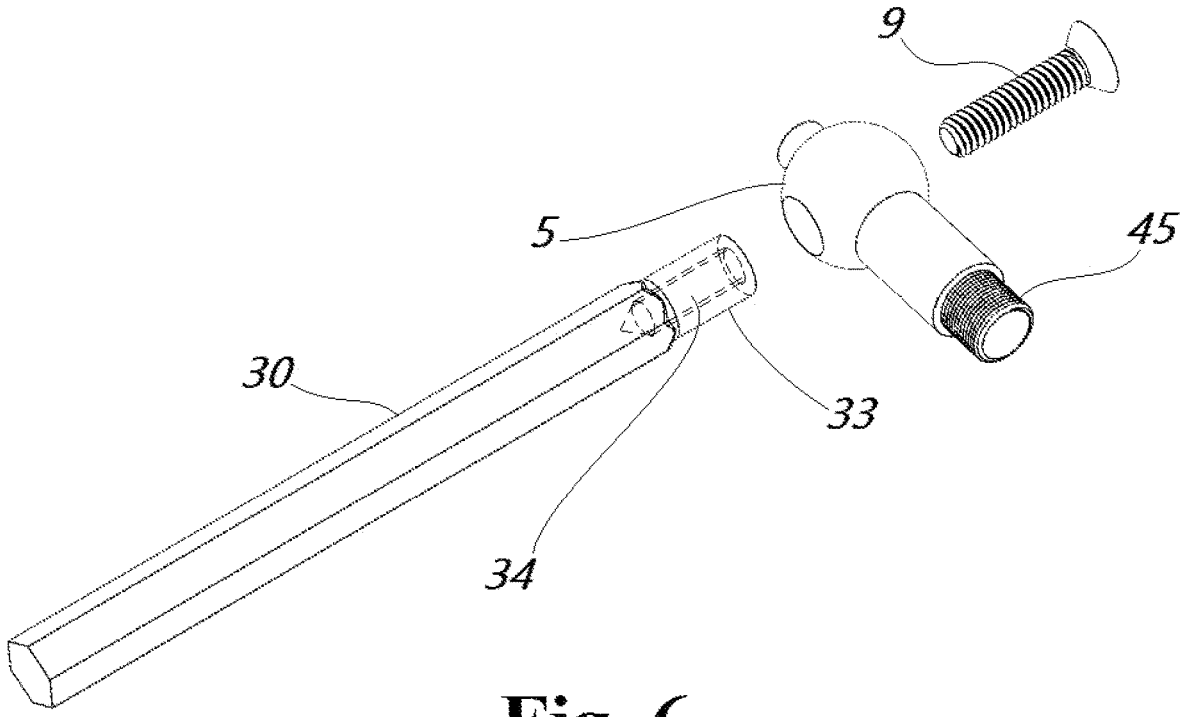
FIG. 6 shows an exploded view of some parts of the tool kit, including a head, a shaft, and a set screw ready for attachment to each other, with the shaft having a frustum, and the head having a complementary bore for mounting to the shaft and threads for attachment to a tip component.

FIG. 6 shows an exploded view of some of the kit parts, including a head component [5,] a shaft component [30,] and a set screw [9] ready for attachment to each other, with the shaft's frustum [33] having a threaded bore [34] for receiving the threaded end of a set screw, and the head component having a threaded end [45] for attachment of a tip component [6 of FIG. 3] which at its first end includes complementary means for attachment to the head component. The head component is shown in further detail in FIG. 7.

Figure 7:
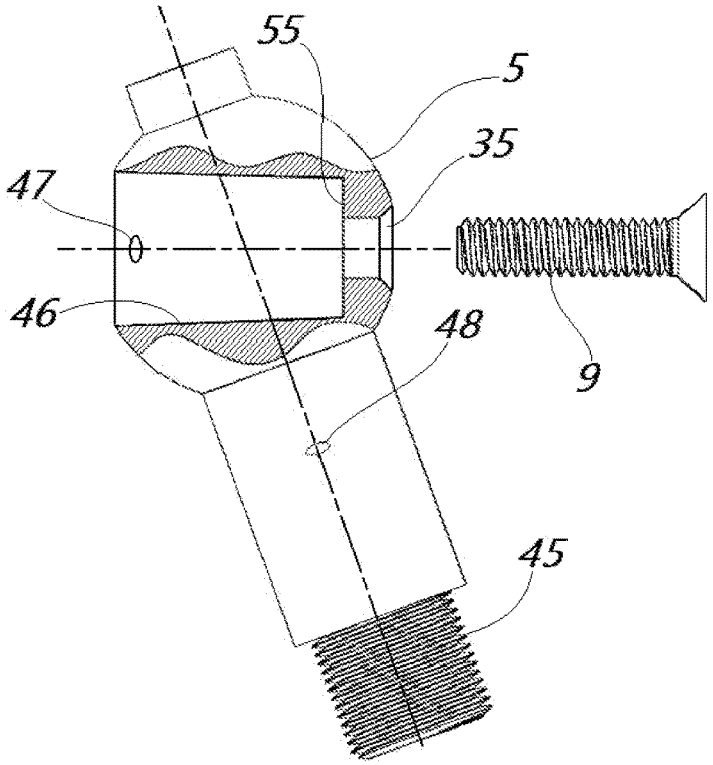
FIG. 7 shows a partial cross section view of a head component showing a first bore for attachment with a shaft component and a second bore for a set screw with the set screw positioned for entry through the second bore to engage the threaded bore of a shaft.

FIG. 7 shows a partial cross section of a head component [5] with its threaded end [45] which is a second end with means for attachment of a tip component [6 of FIG. 3.] The head component includes at a first end means of attachment to the shaft which in this embodiment is a first bore [46] tapered for receiving a frustum of a shaft which extends along an axis [47] to a depth which is a first length dimension and terminates inside the head, and a second bore opposite from and in line with the first bore extending into the head and penetrating the first bore at the center of its termination. The first and second bores meet to form a through-aperture having a second length dimension overall which is a less than the total length dimension of the through aperture. The first bore includes an interior end wall [55] substantially perpendicular to its bore axis.

The second bore in the head component completes the through aperture and is sized to admit the set screw or other threaded fastener, and preferably includes a counter-sink [35] for receiving the set screw [9] which is also preferably countersunk. The axis of the tapered bore [46] is preferably coaxial with the axis of the shaft.

In assembly, the threaded end of a set screw is inserted through the second bore of a head as shown in FIG. 7 passing through the second bore into the first bore and then into the threaded bore of a shaft component onto which the head has been mounted. The set screw is then tightened into the threaded bore of the shaft, thereby pulling the head component tightly onto the shaft.

The threaded end of the head component is a second end which extends from the head along a third axis [48] which may reside perpendicular to the shared axis of the first and second bores of the head, or a head component may be fashioned with any other convenient threaded end angle to the shared axis of the first and second bores such that a set of interchangeable head components may be provided with the kit so that a user may select a most conveniently angled head component from among an assortment of kit parts. When installed onto the shaft, the second axis of the frustum of the shaft and the third axis of the second end of the head component define a plane of orientation for the head component. The socket aperture of the tip component extends along or parallel to this third axis.

Figure 8:
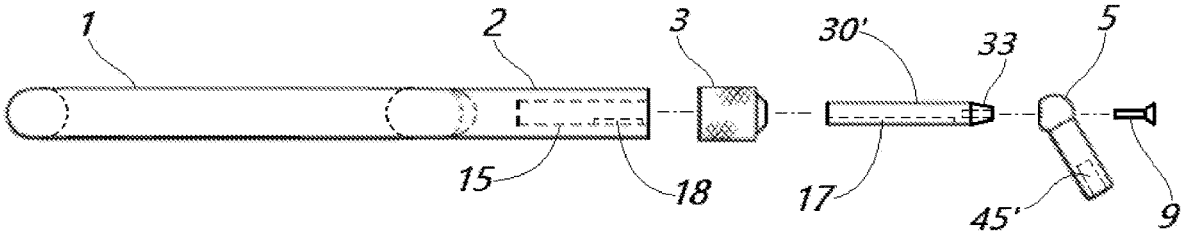
FIG. 8 shows an exploded view of yet another alternative tuning tool kit in accordance with the invention.

FIG. 8 shows an exploded view of yet another alternative tuning tool kit in accordance with the invention. The loop portion [1] and stem portion [2] of the handle are shown, with the stem including an aperture [15] for receiving the shaft [30'] which has a frustum [33] at one of its ends. The head component [5] has a tapered bore complementary to the frustum and may be secured to the shaft by means of a screw [9.] A tip component as described elsewhere but having male threads may be threaded into the female threads [45'] of the projection of the head component. On assembly the shaft is passed through a ferrule [3] with the shaft further comprising a keyway [17] which engages with a key [18] residing in the aperture in the stem portion of the handle. The head and tip are thus extendable from the handle and may be secured by the collet nut at any desired distance from the handle and its loop.

Figure 9A:
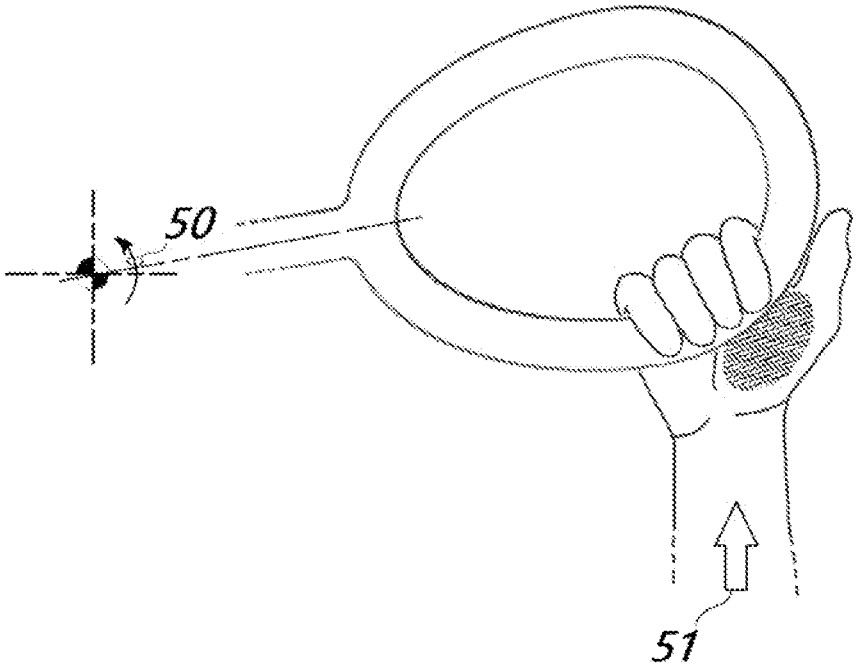
FIG. 9*a* shows a user grasping a handle of an assembled pin turning tool kit, using the wrist in a supinated position to develop torque applied to an instrument tuning pin.

FIG. 9*a* shows a user grasping a handle of an assembled pin turning tool kit, using the wrist in a supinated position to develop torque as shown by arrow [50] applied to an instrument tuning pin. Force generated in the forearm is shown by arrow [51.]

Figure 9B:
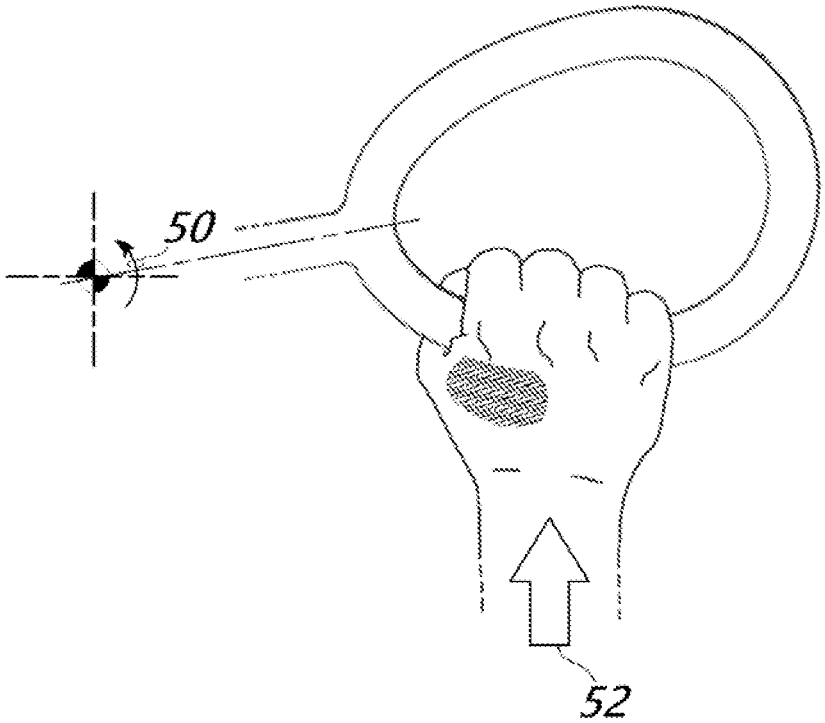
FIG. 9*b* shows a user grasping a handle of an assembled pin turning tool kit, using the wrist in a pronated position to develop torque applied to an instrument tuning pin.

FIG. 9*b* shows a user grasping a handle of an assembled pin turning tool kit, using the wrist in a pronated position to develop torque as shown by arrow [50] applied to an instrument tuning pin. Force generated in the forearm is shown by arrow [52.]

In both FIGS. 9*a* and 9*b* above, although the thumb of the hand is shown adducted close by the grasping fingers, when a preferred handle having an ovoid loop is used as a part of the kit, it is also possible and comfortable for the user to lay the palm side of the thumb along a portion of the loop. A person having a slenderer build may prefer to apply force further away from the center of rotation of the pin, as is seen with the wrist of a lighter build in FIG. 9*a* and the heavier build in FIG. 9*b*. The preferred ovoid offers a wide range of locations and it is easy for a user to feel along the handle without looking and locate a most comfortable purchase point.

When applying force to the tool handle, the novel ovoid loop shape of the tool offers an easy to locate region which will be substantially perpendicular to the long bones of the forearm, which reduces carpal tunnel stress and fatigue when tuning hundreds of tuning pins on several instruments during a work day. When pushing the tool as shown in FIGS. 9*a* and 9*b*, a substantial portion of the force applied to the tool passes through the thenar eminence of the palm, which is the group of muscles on the palm of the human hand at the base of the thumb. This region is shown as a shaded region in FIGS. 9*a* and 9*b*. The turning direction shown by arrow [50] in these figures may represent tightening or slackening of an instrument's musical wire or string as wound around a tuning pin, and forces opposite to the directions shown may be exerted by pulling on the loop handle with the primary forces applied to the tool from the gripping fingers of the hand.

Figure 9C:
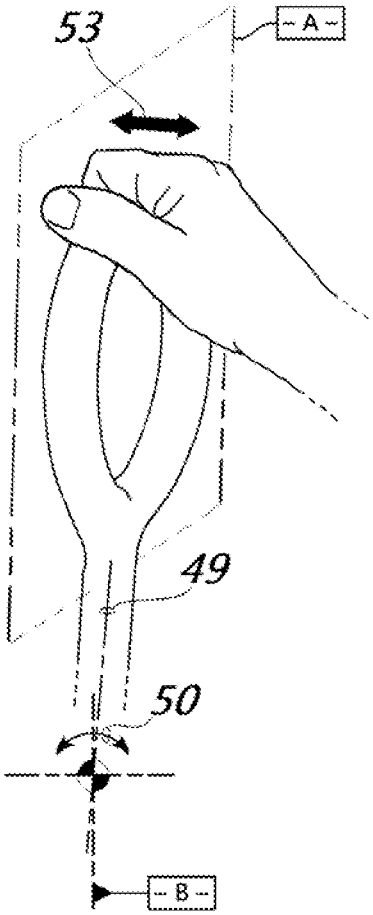
FIG. 9*c* shows a user grasping a handle of an assembled pin turning tool kit, with the handle oriented and locked at a comfortable angle for pushing or pulling on the loop portion of the handle to turn and tune an instrument tuning pin.

FIG. 9*c* shows a user grasping a handle of an assembled pin turning tool kit, with the handle oriented and locked at a comfortable angle for pushing or pulling on the loop portion of the handle to turn and tune an instrument tuning pin. The loop portion of the handle defines a first plane [-A-] which may be a midplane containing the contour of a centerline connecting a series of geometric centers of area taken at a plurality of cross sections selected along the contour of the loop portion. The stem portion extends along a first axis [49] to the distal end of the stem with an axially extending aperture where the shaft or the collet securing the shaft is secured. The second axis of the shaft component and the third axis of the socket aperture define a second plane [-B-] orientable at an angle to the first plane.

The axis of the pin being tuned is perpendicular to this view and so the plane of orientation [-B-] of the head component is also perpendicular and appears as a vertical line. The collet nut threadably coupleable to the ferrule or handle, and the set screw, or both provide adjustable and lockable means for orienting the loop plane at any angle with respect to the plane of orientation of the head component.

Also, although a right hand is depicted, the tool as assembled from the claimed components and orientable for effective use in confined spaces is equally amenable for symmetrically opposite operations by the left hand with equal performance, comfort, and convenience as afforded to right-handed users. Thus the depicted handedness of users as seen in the figures shall not limit or preclude opposite handed uses or forces applied in directions other than the directions indicated by arrows in these figures.

The substantial increase in comfort afforded by the ovoid handle in its various adjustable orientations is not visually obvious, but was discovered by physical experimentation and evaluations of the tactile sensations evinced by the many handle shapes which were tested by the inventor. Thus, as a part of an instrument pin turning and tuning tool kit, to the extent that the word "obvious" means "plain to see," the surprising and useful improvement is not "obvious" because it is not made apparent by mere inspection of available handles seen on other sort of tools, nor by observation of other tool handles or control lever handles in use in their own applications, nor is it conceivable by mental visualization or speculation of how these tool handles would feel in operation. Instead, each shape in the discovery process of the invention was and must be tried in the flesh and viscerally experienced in order to be appreciated, compared, and evaluated from among the many other possible shapes.

Figure 10:
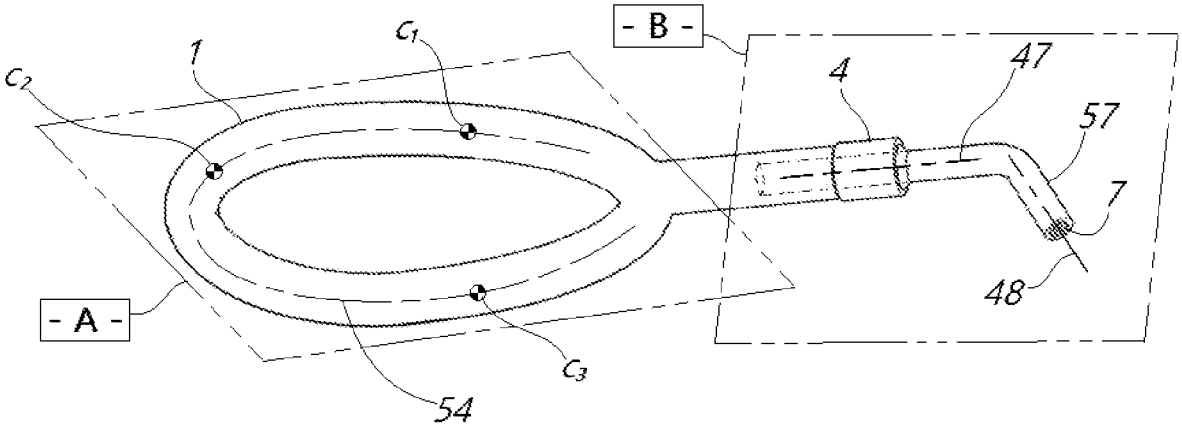
FIG. 10 shows another alternate embodiment of a pin turning tool kit in accordance with the invention, as assembled into an integrated pin turning tool.

FIG. 10 shows another alternate embodiment of a pin turning tool kit in accordance with the invention, as assembled into a musical instrument tuning lever assembly. A first plane [-A-] for the loop portion which is the proximal end of the handle [1] is defined by selecting three center of area points [$c_1$, $c_2$, $c_3$] along the handle contour [54.] The stem portion of the handle extends along a first axis from the loop portion to a distal end which has an axially extending aperture. A tip component [57] has a first end with a shaft portion receivable within the handle stem aperture and extending along a second axis [47,] and a second end with a socket aperture [7] extending along a third axis [48] for engagement with a tuning pin. The second and third axis define a second plane [-B-] orientable at an angle to the first plane so as to provide adjustable and lockable means for orienting the loop plane at any angle with respect to the plane of orientation of the tip component. Lastly, a collet nut [4] is threadably coupled to the stem portion of the handle to secure the tip component within the axially extending aperture of the handle. The collet nut may lock the tip component with its first end fully seated within the handle aperture or the user may lock the tip component at a partially extended location within the handle aperture.

While certain features and aspects have been described with respect to exemplary embodiments, one skilled in the art will recognize that numerous modifications are possible. Also, while certain functionality is ascribed to certain system components, unless the context dictates otherwise, this functionality may be distributed among various other system components in accordance with the several embodiments.

Moreover, while the procedures of the methods and processes described herein are described in a particular order for ease of description, unless the context dictates otherwise, various procedures may be reordered, added, and/or omitted in accordance with various embodiments. Furthermore, the procedures described with respect to one method or process may be incorporated within other described methods or processes; likewise, system components described according to a particular structural configuration and/or with respect to one system may be organized in alternative structural configurations and/or incorporated within other described systems.

The present disclosure is not to be limited in terms of the particular embodiments described in this application, which are intended as illustrations of various aspects. Many modifications and variations can be made without departing from its spirit and scope. Functionally equivalent methods and apparatuses within the scope of the disclosure, in addition to those enumerated herein, are possible from the foregoing descriptions. Such modifications and variations are intended to fall within the scope of the appended claims. The present disclosure is to be limited only by the terms of the appended claims, along with the full scope of equivalents to which such claims are entitled.

Hence, while various embodiments are described with or without certain features for ease of description and to illustrate exemplary aspects of those embodiments, the various components and/or features described herein with respect to a particular embodiment may be substituted, added, and/or subtracted from among other described embodiments, unless the context dictates otherwise. Thus, unauthorized instances of apparatuses and methods claimed herein are to be considered infringing, no matter where in the world they are advertised, sold, offered for sale, used, possessed, or performed.

Consequently and in summary, although many exemplary embodiments are described above, it will be appreciated that the invention is intended to cover all modifications and equivalents within the scope of the following claims.

What is claimed is:

1. A musical instrument tuning lever kit comprising
a handle having
a loop portion at a proximal end,
a stem portion extending along a first axis from said loop portion to a distal end, and
an axially extending aperture at said distal end,
a shaft component
extending along a second axis and receivable within said aperture of said stem portion of said handle and
having means for attachment of a head component,
said head component having
at a first end complementary means for attachment to said shaft component and
at a second end means for attachment of a tip component,
said tip component having
a first end comprising complementary means for attachment to said head component, and
a second end comprising a socket aperture extending along a third axis for engagement with a tuning pin.

2. The musical instrument tuning lever kit of claim 1, wherein said handle comprises a material selected from the set of materials consisting of
wood, plastic, a polyamide, a polycarbonate,
a urethane, an acrylonitrile butadiene styrene,
a polypropylene, an acetal, a polyester, a polyvinyl chloride, an epoxy resin, brass, bronze, epoxy, iron, aluminum, steel, fiberglass, a composite material, a material comprising a carbon fiber, and a metal alloy.

3. The musical instrument tuning lever kit of claim 1, wherein said loop portion of said handle component comprises a contour selected from the set of contours consisting of:
a circle, an oval, an ellipse, an arc, a semi-circle, an ovoid, a bilobate loop, a reniform, a triangle, a square, a rectangle, a rhombus, a parallelogram, a pentagon, a hexagon, and a polygon.

4. The musical instrument tuning lever kit of claim 1, wherein said shaft component comprises a cross sectional profile selected from a set of profiles consisting of:
a round profile, a round profile including a key way, an ovular profile, a rectangular profile, and
a polygonal profile.

5. The musical instrument tuning lever kit of claim 1, wherein said shaft component comprises a frustum on its distal end.

6. The musical instrument tuning lever kit of claim 5, wherein said frustum comprises a Morse taper, and said complementary means for attachment of said head component comprises a complementary Morse taper.

7. The musical instrument tuning kit of claim 1, wherein said head component comprises a through-aperture having a tapered bore of a first length dimension shorter than a total length dimension of said through aperture.

8. The musical instrument tuning lever kit of claim 1, further comprising a threaded fastener, and said shaft component further comprises threading complementary to said threaded fastener.

9. The musical instrument tuning lever kit of claim 1, wherein said loop portion of said handle defines a first plane, and said second axis of said shaft component with said third axis of said socket aperture define a second plane orientable at an angle to said first plane.

10. The musical instrument tuning kit of claim 1, wherein said head component comprises a through-aperture having a tapered bore of a first length dimension shorter than a total length dimension of said through aperture.

11. A musical instrument tuning lever kit comprising
a handle having
a loop portion at a proximal end,
a stem portion extending along a first axis from said loop portion to a distal end, and
an axially extending aperture at said distal end,
a ferrule component,
a shaft component
extending along a second axis and
receivable within said ferrule component and
having means for attachment of a head component,
said head component having
a first end comprising complementary means for attachment to said shaft component and
a second end comprising means for attachment of a tip component,
said tip component having
a first end comprising complementary means for attachment to said head component and
a second end comprising a socket aperture extending along a third axis for engagement with
a tuning pin.

12. The musical instrument tuning lever kit of claim 11, further comprising a collet-nut threadably coupleable to said ferrule component.

13. The musical instrument tuning lever kit of claim 11, wherein said handle comprises a material selected from the set of materials consisting of wood, plastic, a polyamide, a polycarbonate, a urethane, an acrylonitrile butadiene styrene, a polypropylene, an acetal, a polyester, a polyvinyl chloride, an epoxy resin, brass, bronze, epoxy, iron, Aluminum, steel, fiberglass, a composite material, a material comprising a carbon fiber, and a metal alloy.

14. The musical instrument tuning lever kit of claim 11, wherein said loop portion of said handle component comprises a contour selected from the set of contours consisting of:

a circle, an oval, an ellipse, an arc, a semi-circle, an ovoid, a bilobate loop, a reniform, a triangle, a square, a rectangle, a rhombus, a parallelogram, a pentagon, a hexagon, and a polygon.

15. The musical instrument tuning lever kit of claim 11, wherein said shaft component comprises a frustum on its distal end.

16. The musical instrument tuning lever kit of claim 15, wherein said frustum comprises a Morse taper, and said complementary means for attachment of said head component comprises a complementary Morse taper.

17. The musical instrument tuning lever kit of claim 11, wherein said shaft component comprises a cross sectional profile selected from a set of profiles consisting of:

a round profile, a round profile including a key way, an ovular profile, a rectangular profile, and a polygonal profile, and said ferrule component comprises an aperture having a portion with a cross sectional profile complementary to said cross sectional profile of said shaft component.

18. The musical instrument tuning lever kit of claim 11, further comprising a threaded fastener, and wherein said head component further comprises a through-aperture sized to admit said threaded fastener, and said shaft component further comprises threading complementary to said threaded fastener.

19. The musical instrument tuning lever kit of claim 11, wherein said loop portion of said handle defines a first plane, and said second axis of said shaft component with said third axis of said socket aperture define a second plane orientable at an angle to said first plane.

20. A musical instrument tuning lever assembly, comprising a handle having a loop portion at a proximal end defining a first plane, a stem portion extending along a first axis from said loop portion to a distal end, and an axially extending aperture at said distal end, a tip component comprising a first end having a shaft portion receivable within said handle aperture and extending along a second axis, and a second end comprising a socket aperture extending along a third axis for engagement with a tuning pin, whereby said second and third axis define a second plane orientable at an angle to said first plane, and a collet nut threadably coupled to said stem portion of said handle to secure said tip component within said axially extending aperture of said handle.

* * * * *